US010994973B2

(12) United States Patent
Hubener

(10) Patent No.: US 10,994,973 B2
(45) Date of Patent: May 4, 2021

(54) WIRE PULLING WINCHER

(71) Applicant: Carl H Hubener, Topeka, KS (US)

(72) Inventor: Carl H Hubener, Topeka, KS (US)

( * ) Notice: Subject to any disclaimer, the term of this patent is extended or adjusted under 35 U.S.C. 154(b) by 0 days.

(21) Appl. No.: 16/685,915

(22) Filed: Nov. 15, 2019

(65) Prior Publication Data

US 2020/0207594 A1 Jul. 2, 2020

Related U.S. Application Data

(60) Provisional application No. 62/787,074, filed on Dec. 31, 2018.

(51) Int. Cl.

| | |
|---|---|
| ***B66D 1/50*** | (2006.01) |
| ***B66D 3/06*** | (2006.01) |
| ***E04H 17/26*** | (2006.01) |
| ***B66D 3/24*** | (2006.01) |
| ***B66D 1/30*** | (2006.01) |
| ***B66D 3/00*** | (2006.01) |

(52) U.S. Cl.

CPC ..... *B66D 1/505* (2013.01); *B66D 1/30* (2013.01); *B66D 3/006* (2013.01); *B66D 3/06* (2013.01); *B66D 3/24* (2013.01); *E04H 17/266* (2013.01)

(58) Field of Classification Search

CPC ... B66D 1/26; B66D 1/50; B66D 1/56; B66D 1/60; B66D 1/7489; B66D 3/06; B66D 3/24; B66D 3/26

See application file for complete search history.

(56) References Cited

U.S. PATENT DOCUMENTS

| | | | | | |
|---|---|---|---|---|---|
| 4,190,234 | A * | 2/1980 | Coleman | E04H 17/10 | 254/232 |
| 4,846,445 | A * | 7/1989 | Pfeffer | E02D 9/02 | 254/30 |
| 5,526,637 | A * | 6/1996 | Leonard | A01G 23/062 | 254/132 |
| 5,582,216 | A * | 12/1996 | Smith | B21F 33/00 | 140/107 |
| 5,588,500 | A * | 12/1996 | Yonahara | E04G 1/22 | 182/141 |
| 5,806,779 | A * | 9/1998 | Crum | E04H 17/266 | 242/399.1 |
| 6,042,046 | A * | 3/2000 | Beyer, Sr. | B65H 49/32 | 242/399.1 |
| 6,178,603 | B1 * | 1/2001 | Lillig | B25B 25/00 | 24/132 R |
| 6,857,619 | B1 * | 2/2005 | Jangula | E02F 3/96 | 254/132 |
| 7,011,269 | B1 * | 3/2006 | Chouinard | B65H 49/32 | 242/403 |
| 8,746,403 | B1 * | 6/2014 | Tyner | E06C 1/30 | 182/106 |

(Continued)

*Primary Examiner* — Emmanuel M Marcelo

(74) *Attorney, Agent, or Firm* — Bruce J. Clark

(57) ABSTRACT

A wire pulling windier apparatus attachable to a tractor, loader or other mobile transport device capable of receiving attachments has a pass through frame attachable to the mobile device, a vertical support member on the frame for supporting a first winch with cable for attaching and pulling a fence wire to be tensioned, a second winch for raising and lowering a slide block assembly through which the first winch cable is guided to allow pulling the first winch cable at different vertical heights, and has winch tension limiting apparatus.

9 Claims, 5 Drawing Sheets

(56) References Cited

U.S. PATENT DOCUMENTS

| | | | | |
|---|---|---|---|---|
| 9,731,640 | B1 * | 8/2017 | Meacham | B60R 3/00 |
| 2001/0045554 | A1 * | 11/2001 | Pulliam | A01K 3/00 256/65.14 |
| 2002/0130309 | A1 * | 9/2002 | Hulburd | B66D 3/02 254/369 |
| 2004/0065767 | A1 * | 4/2004 | Parker | A01K 3/00 242/557 |
| 2004/0065768 | A1 * | 4/2004 | Parker | B65H 49/32 242/557 |
| 2004/0227031 | A1 * | 11/2004 | Yoder | E04H 17/266 242/390.5 |
| 2005/0133776 | A1 * | 6/2005 | Capps | E04H 17/266 256/32 |
| 2006/0289693 | A1 * | 12/2006 | Saavedra | B65H 49/325 242/557 |
| 2007/0074935 | A1 * | 4/2007 | Zahn | B66F 9/07545 182/141 |
| 2008/0258003 | A1 * | 10/2008 | Foster | E04H 17/266 242/611 |
| 2010/0090053 | A1 * | 4/2010 | Stiltner | B65H 49/321 242/594.4 |
| 2012/0048988 | A1 * | 3/2012 | Pulver | B65H 49/32 242/557 |
| 2012/0138386 | A1 * | 6/2012 | Robitaille | A62B 35/0068 182/3 |
| 2012/0256149 | A1 * | 10/2012 | Sylvester | E01F 13/028 256/73 |
| 2016/0138338 | A1 * | 5/2016 | Olson | E06C 1/39 182/113 |
| 2016/0145939 | A1 * | 5/2016 | Smith | E04G 1/34 182/113 |
| 2018/0044868 | A1 * | 2/2018 | Miller | E04H 17/00 |

* cited by examiner

WIRE PULLING WINCHER

BACKGROUND OF THE INVENTION

This invention relates to the field of fence wire pullers, for barb or nonbarb wire.

The process of setting a several strand wire fence is a tedious and labor intensive process that involves a series of posts, typically t-posts, to which the wire (s) will be secured upon tightening. The last two of these line posts in each pulling procedure is referred to as the brace post and the end post. After setting the t-posts, the end post, and the brace post, the barb wire(s) is dispensed, laid along the ground next to the posts. The task of pulling the wire to the proper tension and securing the wire end to the post needs to be performed. Typically this process requires pulling the wire from the end post. Normally a rope puller or fence wire puller is affixed to the end post at or near the height that the wire is to be tied. These are manually pulled and work mostly for short distances of wire. All are attached to the end post. After the wire is tensioned, it must be tied to the end post which is difficult with the pulling device in the way. The puller must be attached to the end post at the proper wire height and to the wire to be pulled and then winched manually. The wire then needs to be tied off on the end post near where the puller is attached, sometimes unsafe.

The process is currently slow, cumbersome and sometimes awkward, as well as unsafe.

Often the wires are pulled at different tensions, thus the various wires on a fence containing four or five wires has fence wire that is at different tensions.

Its also cumbersome to reset the puller height each time for the next wire height.

What is needed is an electric winch assembly that is attachable to a loader that overcomes these problems.

The invention is a winch assembly attachable to a loader or other mobile means with attachment means for moving the assembly. It has a walk through frame to allow one to walk back and forth on both sides of the apparatus during winching.

It also allows for pulling the wire from a few feet in front of the end post without having the puller attached to the end post interfering with tying off the fence wire.

It also allows for pulling at different heights and doing so quickly and easily lowering the winch to a desired height for pulling that matches the level of the wire placement on the post.

It also allows for a consistent tension for pulling the wire.

It also has means for pulling at different angles, in this case rotation means.

It has electric powering means to operate by remote control.

It has means for quickly disconnecting and connecting to the next lower wire by providing slack automatically on positioning the puller horizontally.

It is attachable quickly to standard tractors, skid loaders or other mobile attachment means.

It allows short or long length pulls, and thus as show is much faster when pulling multiple wires over long distances.

It allows the operation to be done in a safer manner as well, including allowing the wire to be tied off to the end post without interference of the puller at the tie off point.

It is thus not only safer, it does the job much more easily, in an organized and consistent method, saving as much as half the time to install a barbed wire fence as with other pullers.

Remote control means allows for controlling the pulling without having to be next to the winch, to allow the operator to check or guide wire during the pull, or better view the safe pull of the entire wire from some vantage point, or to assist as needed during the pulling.

It is thus more universal and flexible in use, allowing for use at different heights, locations and distances, yet still provides more uniformity.

While some may have used winches, none are shown in a manner to achieve the objectives herein.

It is thus an object of the invention to provide a means for quickly, easily, uniformly pulling fence wires taut for securing to fence posts, at desired levels, at essentially uniform tensions, and in a manner that is safe and allows for the operator to maneuver himself and the wire easily and efficiently.

Other features and objectives will be apparent from the disclosure herein.

SUMMARY OF THE INVENTION

The invention is a wire pulling wincher apparatus attachable to a tractor or other mobile transport device capable of receiving attachments, having a pass through frame attachable to the mobile device, a vertical support member on the frame for supporting a first winch with cable for attaching to a fence wire to be pulled, a second winch for raising and lowering a slide block assembly through which the cable is guided to allow pulling the cable at different vertical heights, a winch limit switch for sensing a tension limit in the cable and able to stop the winch at the desired tension, and remote control means for operating the first winch.

DESCRIPTION OF THE PREFERRED EMBODIMENTS

Figure 1:
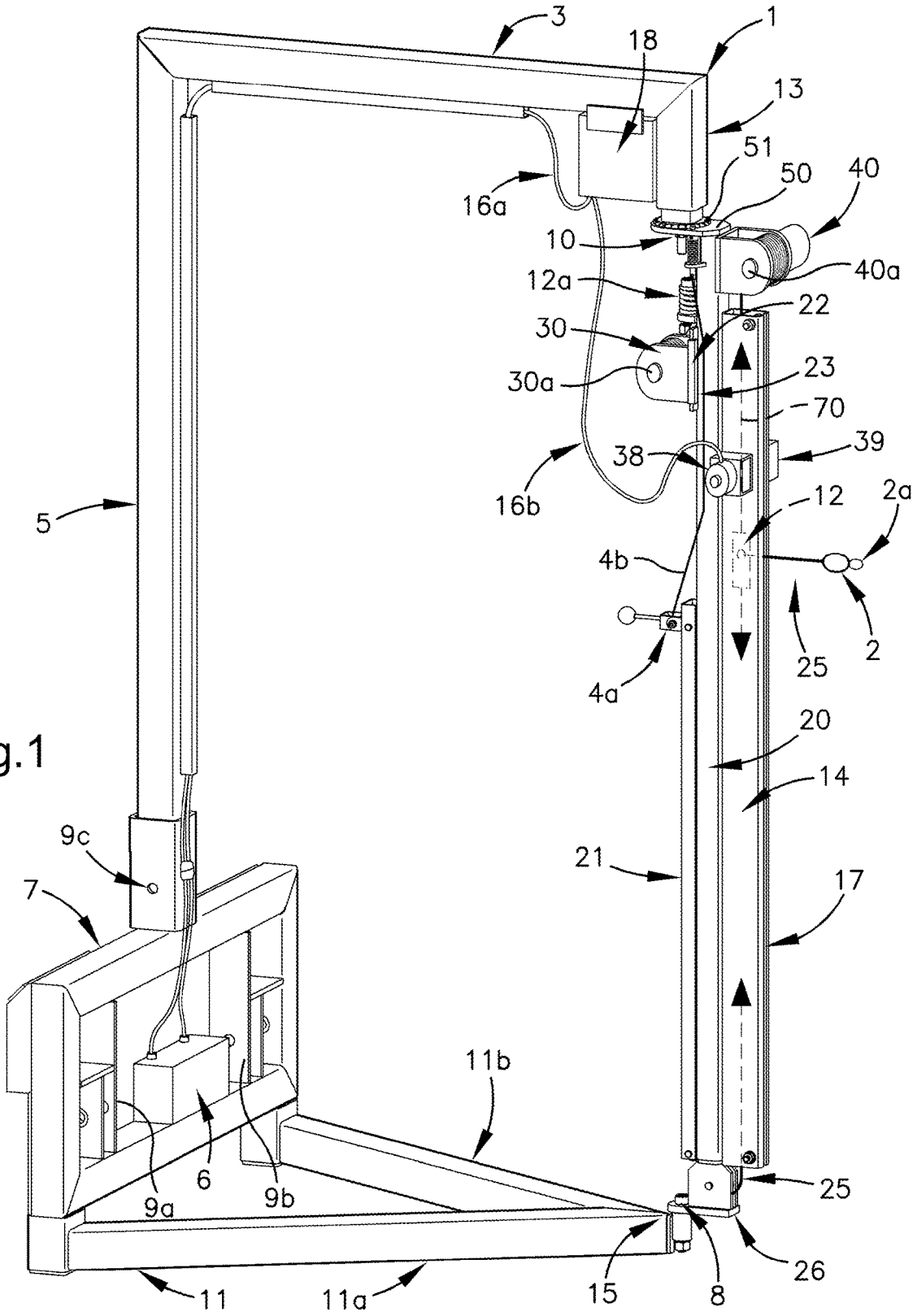
FIG. 1 is an overall perspective of the invention.

The invention is shown in FIG. 1 in the preferred mode having a frame 1 that, in the preferred mode, allows for the individual operator to walk through or pass through with ease when in use with the loader or other mobile device to which it is attached on one side while the other is attached to and tensioning the fence wire. Base frame 11 and top frame member 3 are spaced apart sufficiently to allow such a pass through although other embodiments are envisioned to accomplish this space between the fence connection and the loader. Frame 1 has back frame member 5 therebetween, which in the preferred mode also has a lower structure, back frame base assembly 7, that allows for attachment means 9*a*, 9*b* and 9*c* for attaching to a tractor, steer loader, or other mobile transport means. As shown, the lower structure also allows for storing battery means 6 for powering the winches. The base frame 11 is in this mode comprised of a first base frame member 11*a* and a second base frame member 11*b* that are connected at a base frame juncture 15. The two base frame members are attached to the back frame assembly 7.

Any structure for a base that allows for a pivot point at lower pivot pin 8 to support the vertical support bar 20 is envisioned.

These parts described create a rigid frame 1 capable of supporting the vertical support bar 20 and its structure and other elements including winch or other pulling means, that in the preferred mode is pivotally situated between the top frame member 3 base frame member 11 at lower pivot pin 8 and upper pivot point 10.

The vertical support bar 20 has key elements attached to it, including at least a manual or electric wire pulling means that allows for various vertical levels for pulling the wire. In the preferred mode, this is accomplished via a wire pulling winch 30 working in combination with a vertical adjustment winch 40 and with means for limiting the pulling when a desired tension is achieved. These tension limiting means are shown as 12 in FIG. 1 but are shown in more detail in FIG. 2.

Pivot means is achieved at the bottom as shown having lower rigid bracket 26 that is attached to the vertical support bar, pivoting on lower pivot pin 8 that is attached to the base frame 11, which is this mode has pin 8 extending through a hole in the lower bracket. Pivot means at the top is achieved with a rotation sprocket and plate assembly pivot about pivot point 10, shown in more detail in FIG. 2.

Vertical support bar 20 has attached to it on one side slide sleave means for allowing vertical positioning of the pulling cable loop 2. In the preferred mode it is comprised of the slide sleeve assembly 12 that functions to provide the vertical position of the wire loop 2 via a separate positioning cable 70 that is connected at one end to the slide sleeve assembly, and the opposite end to the winch 40 that raises and lowers the slide sleeve assembly 12 as desired. The tensioning cable 25 is threaded over pulley means in the slide sleeve assembly and directed downward to the lower sheave (pulley) means 27 in the lower bracket (shown in more detail in FIG. 3) and redirected back up to the winch 30 protected by cable guard 21. Thus the wire tensioning winch 30 works in conjunction with vertical positioning winch 40 via the slide sleeve assembly to allow both the pulling of the wire in an essentially horizontal direction at various desired vertical heights. Tensioning cable 25 is shown extending through slit 17 of the slide sleeve assembly. This slide sleeve assembly is shown in more detail in FIG. 2.

Tension limiting means 12 provides for limiting the tension of the wire inasmuch as winches can pull at tensions much greater than that needed. This also provides a means for uniform tension to the various fence wires, as well as a safety feature. In this mode, such means are provided in the following manner. Tensioning winch 30 is attached, either removably or permanently, to plate 23, which plate is slidably connected to slide plate 23. Plate 23 works in conjunction with spring means and electrical switch means so as to turn off the power to the winch when the winch is pulled down during tensioning. This is shown in more detail in FIG. 2.

Wires 16*a* from the battery 6 are fed to the control box 18. Power from the control box also feeds the winches 30 and 40, and their respective switches, i.e. the control switch 38 for the height winch 40 and the remote control relay switch 39 for the tension winch 40.

Figure 2:
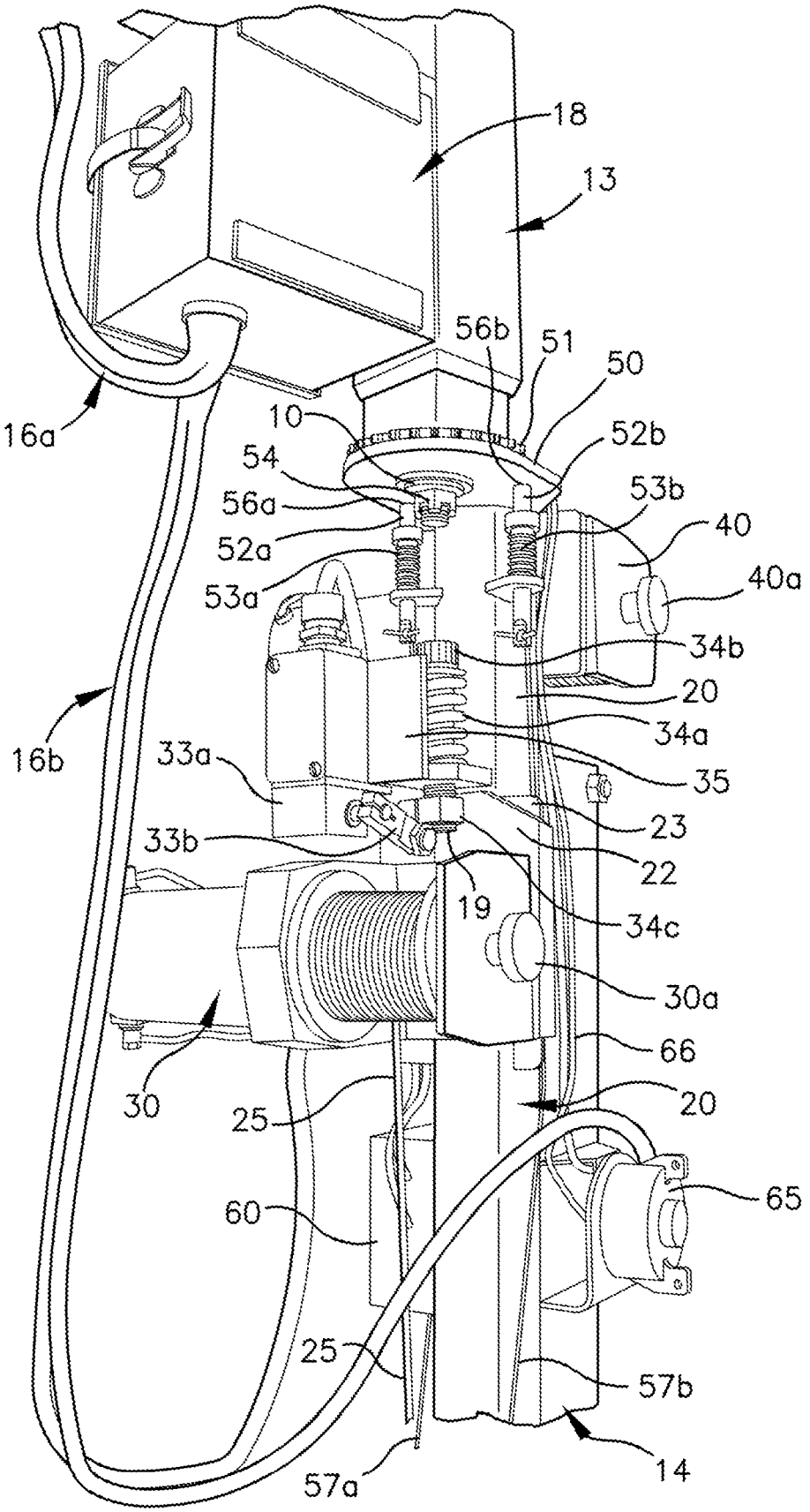
FIG. 2 is a view upper assembly

FIG. 2 shows some of the above features in more detail. Rotation plate 50 is rotatably attached to sprocket 51 that is attached to the upper frame arm 13 via pin 54 that is centered and attached to the sprocket 51. Sprocket 51 has in the preferred mode 24 teeth with spaces in between to match at least one pin hole in the plate 50 such that pin 52*a*, which is spring loaded, to normally force the spring into the hole in the plate 50 up in between two teeth in the sprocket 51. The pin is pulled downward against the spring 53*a* via cable 4*b* attached to lever 4*a* to release the pins from the sprocket teeth. In another mode there is at least two or more such pins and holes, offset so that only one hole at a time is aligned with the sprocket teeth so as to allow a finer selection of positions, i.e. more positions become available in smaller increments.

The tensioning limiting means has limit switch 33 affixed to bracket 35 such that switch arm 33*b* is springloaded and normally up, and when normally up, it is electrically closed to allow power to the winch 30 via a power relay. When pulled down sufficiently, the arm 33*b* then disconnects the power. This will occur when the winch, attached to winch mounting plate 32 slides down winch slide plate 33 as the tension on the winch increases during pulling. The counter tension is provided via the limit tension spring 34*a* held in place by elongated bolt 34*b* that extends through the spring, though the bracket 35 and attached to the plate 22. This is shown as connected to the plate via nut means welded to the plate, with the bolt screwed into the nut. Other modes are envisioned to limit the tension to a maximum and adjustable setting as desired, including hinged means instead of slidable means.

Figure 3:
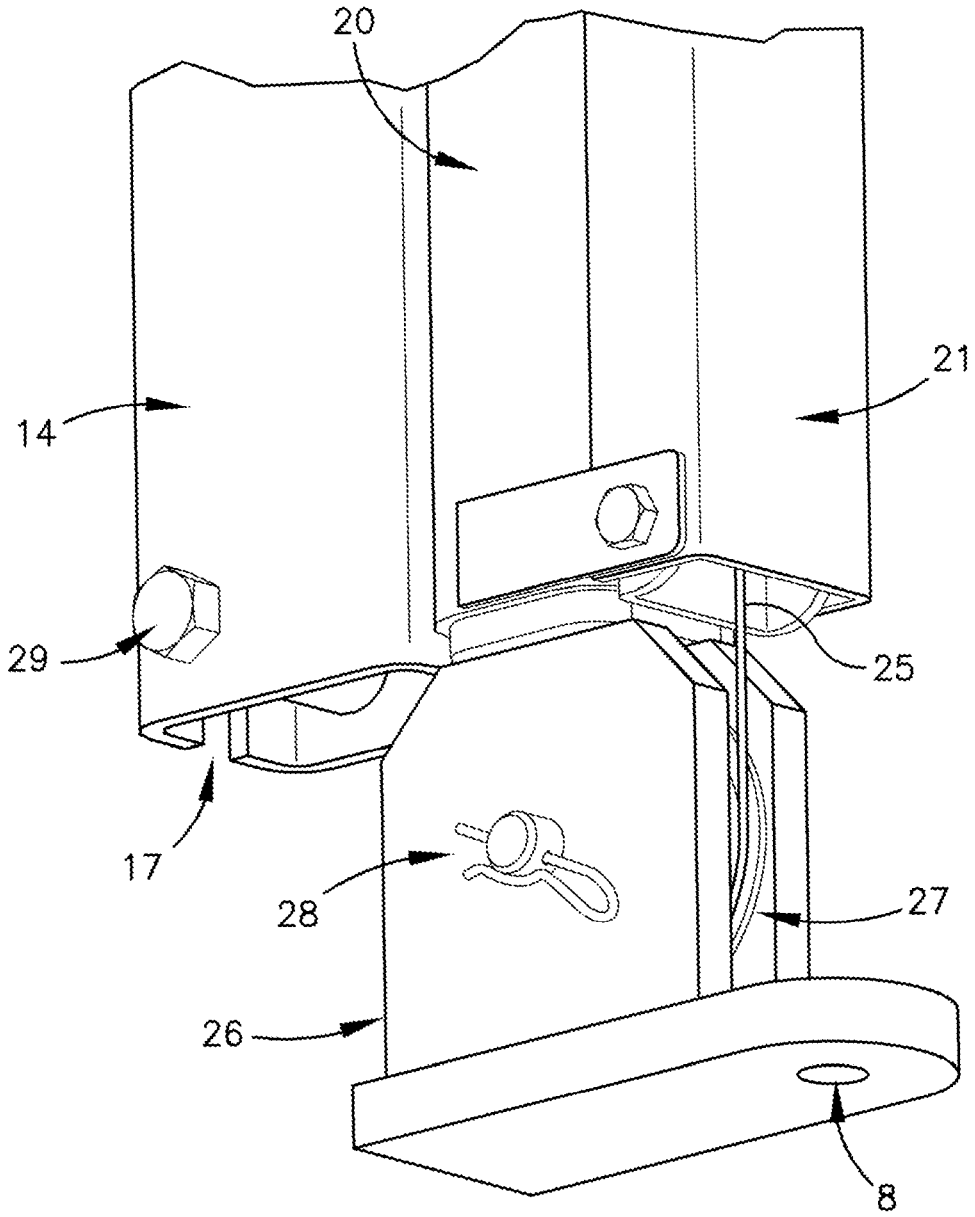
FIG. 3 is a view of the lower assembly

The lower assembly is shown in FIG. 3. Wire tension cable sheave, or lower sheave 27, is a pulley means to redirect the direction of the cable upwards held in place via sheave pin 28. Lower slide stop 29 provides a stop for the slide assembly 70, and also serves as a support and spacer for the two sides of the cable channel 14.

Figure 4A:
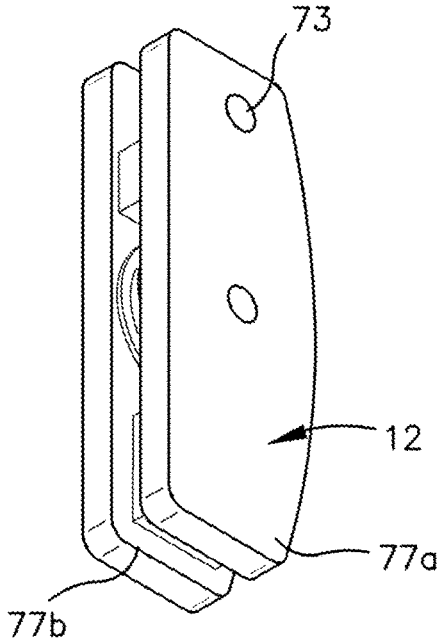
FIG. 4*a* is a view of the slide block assembly
Figure 4B:
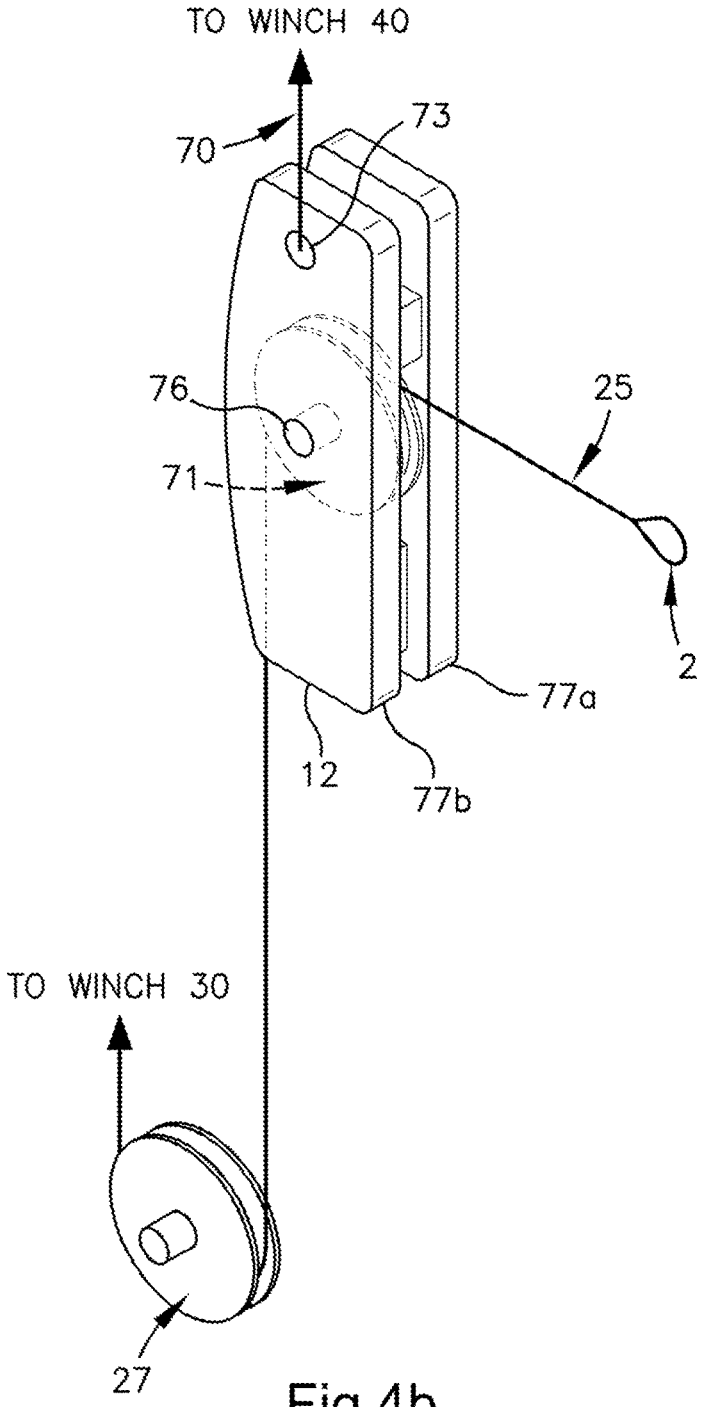
FIG. 4*b* is a view of the slide block assembly with cables

The slide plate assembly 12 is shown in FIGS. 4*a* and 4*b* with pulley or sheave means 71 rotationally connected, via pin 76, between two plates 77*a* and 77*b*, which plates are connected to each other via separate rigid spacers attaching the two sides, which are typically welded. Cable 70 connects to the hole 73 so as to allow for raising and lowering of the slide assembly 12 to the desired height for the wire loop 2. Loop 2 is attached to a cable clamp 2*a* that can removably attach to the desired fence wire to be tensioned. Cable 25 extends as shown around lower sheave 27.

Figure 5:
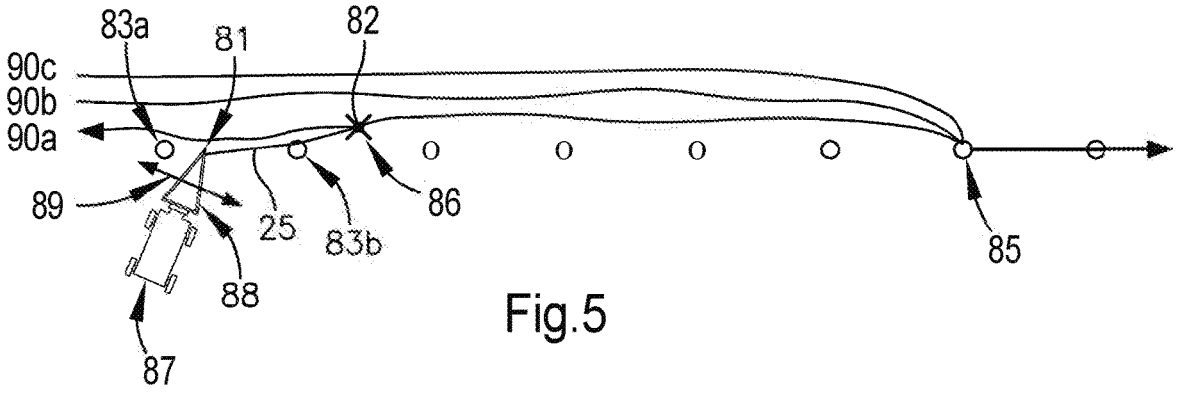
FIG. 5 shows the device used with respect to the posts.

In use, shown in FIG. 5, the invention 88 is attached to loader 87. Fence posts are shown with the last prior braced post 85 having fence tensioned and pulled to that point. There now are one or more strands 90*a*, 90*b*, 90*c* of fence laid out to be tensioned and secured. The top fence wire 90*a* will be pulled first. The operator pulls up to the brace pipe or other rigid support member attached to brace post 83*b* so that the pulling point of the invention (approximately the pivot point 8) is at 81. It is best that point 81 be several feet inside of the end post 83*a*. Here it can be seen that the typical fence tensioner is attached to the end post itself instead. The unit is then lowered to the ground by the loader so that the base 11 is on the ground. Then align the device with the wire to be pulled. Here, regardless of what angle the loader and attachment are pulled in at, the invention is rotated about the pivot point via the rotational sprocket means to line up as desired. The winch clutch 30*a* for winch 30 is then released so that the cable 25 can be pulled out a desire distance and connected to the clamp 2*a* so that the cable 25 is now attached to the fence wire. If not at the desired height, the height winch should be activated to set the cable loop 2 to the desired height with manual control switch. The winch clutch 30*a* is then reset, and the cable 25 is then ready to pull by activating the remote control when ready, to turn the tension winch 30 on. When the winch 30 is pulled down (via slide plate 23 with mounting plate 22) the sufficient distance due to the desired tension, it will turn off via winch limit switch 33*a*, where switch arm 33*b* is brought downward at contact point 19 as limit tension nut 34*c*. (This winch tension limit is adjustable as needed between fence pulls by adjusting the spring tension by adjusting the tension bolt 34*b*, or in other ways, such as by having adjustable means at the contact point 19). When the winch 30 stops, tie the fence wire end to the end post. It is seen that this is accomplished without interference of a fence puller tied to the end post. It can also be seen in FIG. 5 that the device allows one to pass through at the double arrows 89 during the process.

To tension the next lower wire on the fence post, one first lowers the slide assembly by activating wire height winch 40 to lower the assembly 12. This automatically releases the tension on the cable 25 to allow disconnecting the clamp, so that the clamp can now be attached to the next lower wire 90*b*.

Figure 6A:
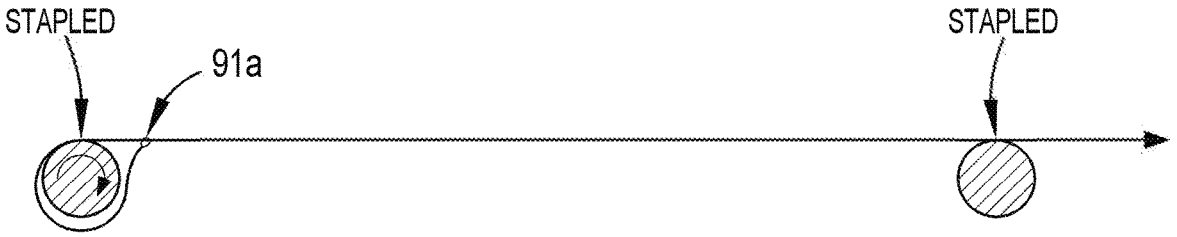
Fig.6a (Prior Art)
FIG. 6*a* is a view of a fence tie off with a typical manual puller attached to the end post
Figure 6B:
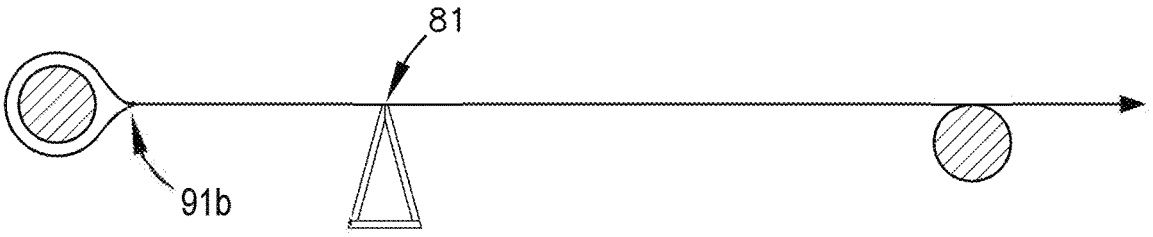
FIG. 6*b* is a view of the fence tie of using the invention

It can now be seen with use how the invention also reduces the tendency of imparting fence twisting tie offs as often occurs using typical fence pullers attached to the end post and tied off at 91*a* while the puller is attached (FIG. 6*a*) versus using the invention to pull at 81 then tying off at 91*b* (FIG. 6*b*). The slack in 91*b* that if provided by pulling at 81 allows circling around the post and centering. When the clamp is let loose and the fence pulls the connection tight at 91*b*, it pulls from the center, with no twisting motion. In the prior art, the fence wire is stapled tight, then tied off at 91*a*. This causes the wire to cause the fence post to twist as shown with the arrow in FIG. 6*b* because of the brace member used to secure the post, an undesirable result, because this constant twisting force over time causes the post to loosen and the fence wire thus to loosen. This does not occur when using the current invention.

Thus, what is shown is a wire pulling wincher apparatus for fence wire tensioning for use with loaders and the like that meets the objectives. Other objectives and features are apparent in this specification and to those skilled in the art.

I claim:

1. An apparatus attachable to a mobile transport means for pulling a fence wire taut along a series of fence posts, said apparatus comprised of:

a. A rigid frame releasably attachable to said mobile transport means;

b. Fence wire pulling means attached to said rigid frame for pulling fence wire taut along said series of posts which series includes at least a tie-off post and an immediately preceding post in the series, so as to allow said fence wire to be secured to the tie-off post when the apparatus is positioned between the tie-off post and the said immediately preceding post while the fence wire is pulled taut, where said fence wire pulling means is comprised of at least one winch means attached to the rigid frame and a fence wire pulling cable, where said fence wire pulling cable has a first end windably connected to said winch means and a second end is releasably attachable to the fence wire at a connection point;

c. Vertical adjustment means so as to allow the fence wire to be pulled at a desired vertical level with respect to the fence post.

2. An apparatus attachable to a mobile transport means for pulling a fence wire taut along a series of fence posts, said apparatus comprised of:

a. A rigid frame releasably attachable to said mobile transport means;

b. Cable winch means attached to the rigid frame;

c. A fence wire pulling cable having a first end and a second end, wherein the first end is releasably attachable to the fence wire at a connection point and the second end is windably connected to said cable winch means so as to allow for pulling the fence wire;

d. At least one directional pulley for redirecting the fence wire pulling cable;

e. Means for adjusting the vertical height at which the pulling of the fence wire occurs by raising or lowering said at least one directional pulley;

f. Automatic tension control means so as to stop the fence cable winch from further winding when a predetermined tension in the fence wire is achieved.

3. Apparatus attachable to a mobile transport means for pulling a fence wire taut along a series of fence posts, said apparatus comprised of:

a. A rigid frame releasably attachable to said mobile transport means;

b. Cable winch means attached to the rigid frame;

c. A wire pulling cable having a first end and a second end, wherein the first end is releasably attachable to the fence wire at a connection point and the second end is windably connected to said cable winch means so as to allow for pulling the said fence wire;

d. A first pulley connected to the rigid frame for redirecting the fence pulling cable;

e. A second pulley slidably attached to the rigid frame for further redirecting the fence pulling cable to allow the fence wire to be pulled from different desired vertical positions;

f. Means for adjusting the position of the second pulley comprised of a second winch attached to the second pulley by a second winch cable windably connected to the second winch, so as to allow the second pulley to move essentially vertically in response to the winding of the second winch;

g. Automatic tension control means so as to stop the fence cable winch from further winding when a predetermined tension in the fence wire is achieved.

4. The fence wire pulling attachment in claim 2 or 3 where the automatic tension control means is comprised of a spring means attached between the rigid frame and the cable winch means, and an electrical switch attached to the frame, where the cable winch means is moveably attached to the rigid frame so as to allow the cable winch means to move in relation to the rigid frame as the cable winch means pulls the wire taut, such that the winch movement activates the switch when in a predetermined position so as to turn off power to the cable winch means in response to the location of the cable winch means during pulling by said cable winch means.

5. The fence wire pulling apparatus in claim 2 or 3 having means for automatically slackening the fence wire pulling cable tension before disconnecting the fence wire from the fence wire pulling cable.

6. An apparatus attachable to a mobile transport means for pulling a fence wire taut along a series of fence posts, said apparatus comprised of:

a. A rigid frame having means for releasably attaching the frame to said mobile transport means, said frame having a rigid top member, a rigid base member, a rigid back member connected between the top and base members, a rigid front member connected between the top and base members and said rigid front member having a top end and a bottom end where said rigid front member is rotationally connected to the top and base members of the frame at the top end and bottom end;

b. Cable winch means attached to the front member;

c. A fence wire pulling cable having a first end and a second end, wherein the first end is releasably attachable to the fence wire at a connection point and the second end is windably connected to said cable winch means so as to allow for pulling the fence wire;

d. A first pulley connected near the bottom of the front member for redirecting the fence pulling cable;

e. Cable guide channel in the front member;

f. A second pulley slidably retained within the cable guide channel;

g. A pulley control winch attached near the top end of the front member;

h. A pulley control cable having a first end windably connected to the pulley winch and a second end attachable to the second pulley so as to allow the said second pulley to slidably move within the cable channel in response to the winding of the pulley control winch;

i. Automatic tension control means comprised of a spring means attached between the rigid frame and the cable winch means, and an electrical switch attached to the frame, where the cable winch means is moveably attached to the rigid frame so as to allow the cable winch means to move in relation to the rigid frame as the cable winch pulls the wire taut, such that the winch movement activates the switch when in a predetermined position so as to turn off power to the cable winch means in response to the location of the cable winch means during pulling by said cable winch means.

7. The fence wire pulling apparatus in claim 6 having segmented releasable locking means for controlling the rotational movement of the front member.

8. The fence wire pulling apparatus in claim 6 having means, after the cable winch means has stopped, for slackening the fence wire pulling cable before the fence wire is disconnected from the fence wire pulling cable.

9. The fence wire pulling apparatus in claim 6 where the cable winch means and pully winch are electrically powered and controlled independently.

* * * * *